US006361339B1

(12) United States Patent
Zhang et al.

(10) Patent No.: US 6,361,339 B1
(45) Date of Patent: Mar. 26, 2002

(54) ELECTRONIC CARD CONNECTOR HAVING AN INTEGRAL EJECTOR MECHANISM

(75) Inventors: JianQiang Zhang; ZhengHua Xu, both of KunSan (CN); DuznZheng Xu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/695,132

(22) Filed: Oct. 23, 2000

(30) Foreign Application Priority Data

Jun. 3, 2000 (TW) ..... 089209520

(51) Int. Cl.[7] ..... H01R 13/633
(52) U.S. Cl. ..... 439/160
(58) Field of Search ..... 439/160, 159, 439/152–158

(56) References Cited

U.S. PATENT DOCUMENTS 5,139,435 A * 8/1992 Komatsu et al. ..... 439/159
5,456,610 A * 10/1995 Banakis et al. ..... 439/157
5,672,072 A * 9/1997 Arai et al. ..... 439/160
RE35,938 E * 10/1998 O'Brien et al. ..... 439/160

* cited by examiner

*Primary Examiner*—Gary F. Paumen
(74) *Attorney, Agent, or Firm*—Wei Te Chung

(57) ABSTRACT

An electronic card connector includes an insulating housing (10) defining a plurality of passageways (104) therein, a plurality of conductive terminals (13) received in the passageways, and an integrally formed ejector mechanism (12). The ejector mechanism includes two bars (120, 121) substantially perpendicularly to each other. An ejection tab (123) rearwardly and downwardly depends from a free end of one bar for abutting an electronic card (2) received in the housing. An actuation portion (124) is provided on a free end of the other bar. When a lateral force is exerted on the actuation portion, the bars rotate, and the first ejection tab moves rearwardly to eject the electronic card out of the connector.

1 Claim, 4 Drawing Sheets

ELECTRONIC CARD CONNECTOR HAVING AN INTEGRAL EJECTOR MECHANISM

FIELD OF THE INVENTION

The present invention relates to an electronic card connector having an ejector mechanism, particularly to an electronic card connector having an integral ejector mechanism.

BACKGROUND OF THE INVENTION

Electronic card connectors are used with electronic cards and are provided with various attachments, such as ejector mechanisms for facilitating the inserting and/or ejecting of the electronic cards. Conventional ejector mechanisms, as disclosed in U.S. Pat. Nos. Re 35,938, 5,456,610, 5,644,917 and 5,139,435, are formed of various separate components, requiring an inconvenient assembly process and a high cost. Additionally, all components of the ejector mechanisms need to be precisely positioned with respect to each other, which makes manufacturing and assembling operations difficult.

BRIEF SUMMARY OF THE INVENTION

A main object of the present invention is to provide an electronic card connector of small size and occupying small space within an electronic device.

Another object of the present invention is to provide an electronic card connector with an ejector mechanism which is integrally formed to simplify the manufacturing and reduce the cost of the connector.

An electronic card connector in accordance with the present invention includes an insulating housing, a plurality of conductive terminals received in the housing and an integrally formed ejector mechanism. The insulating housing includes a plurality of terminal receiving passageways for holding the conductive terminals. The ejector mechanism is integrally formed and includes a first bar and a second bar, substantially perpendicular to each other. A first ejection tab rearwardly and downwardly depends from a free end of the first bar and is substantially perpendicular to the first bar for abutting an electronic card received in the housing. An actuation portion is provided on a free end of the second bar. When a lateral force is exerted on the actuation portion, the first and second bars rotate and the first ejection tab of the first bar moves rearwardly to eject the electronic card out of the connector.

DETAILED DESCRIPTION OF THE INVENTION

Figure 1:
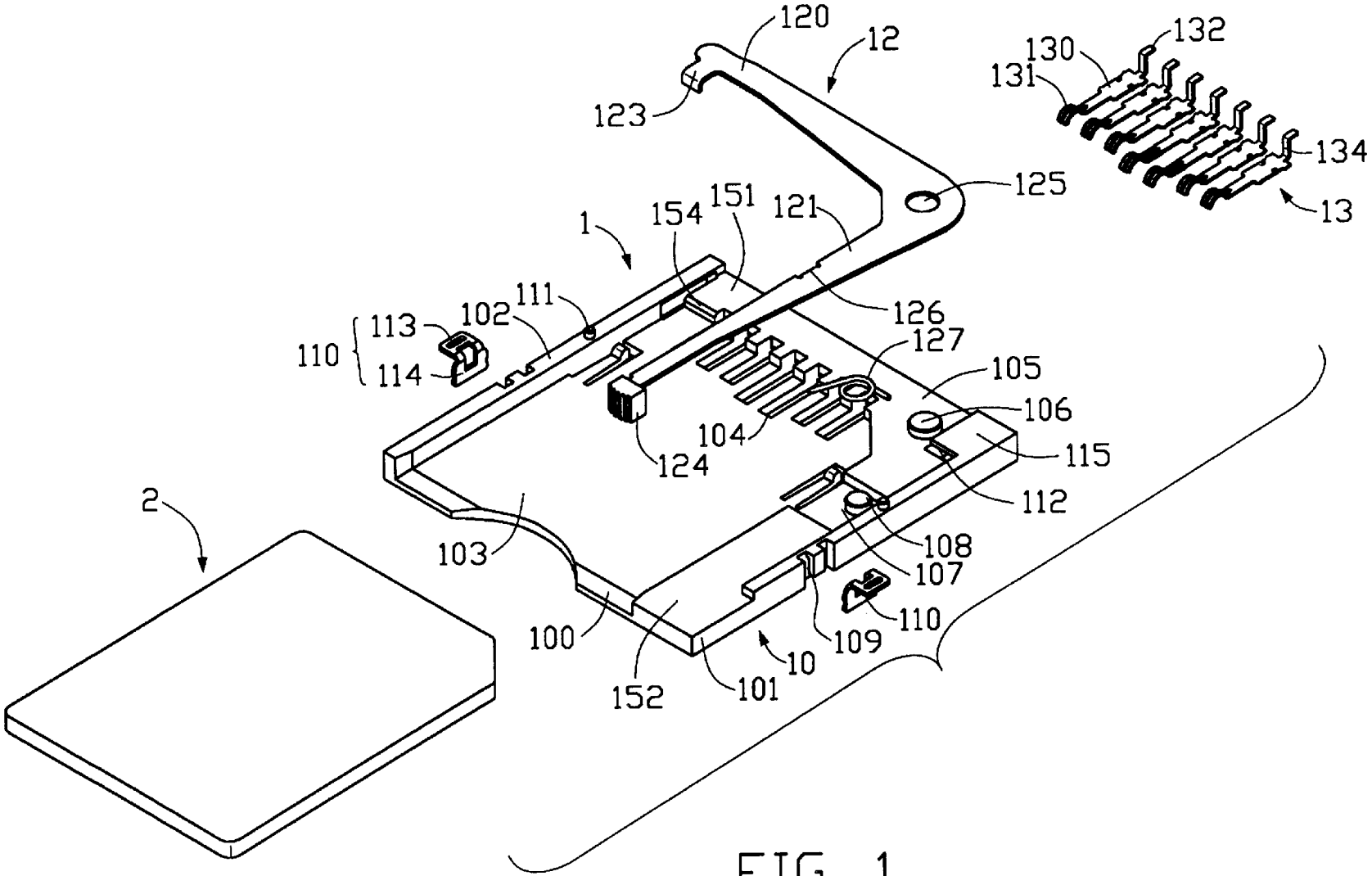
FIG. 1 is an exploded view of an electronic card connector of the present invention.
Figure 2:
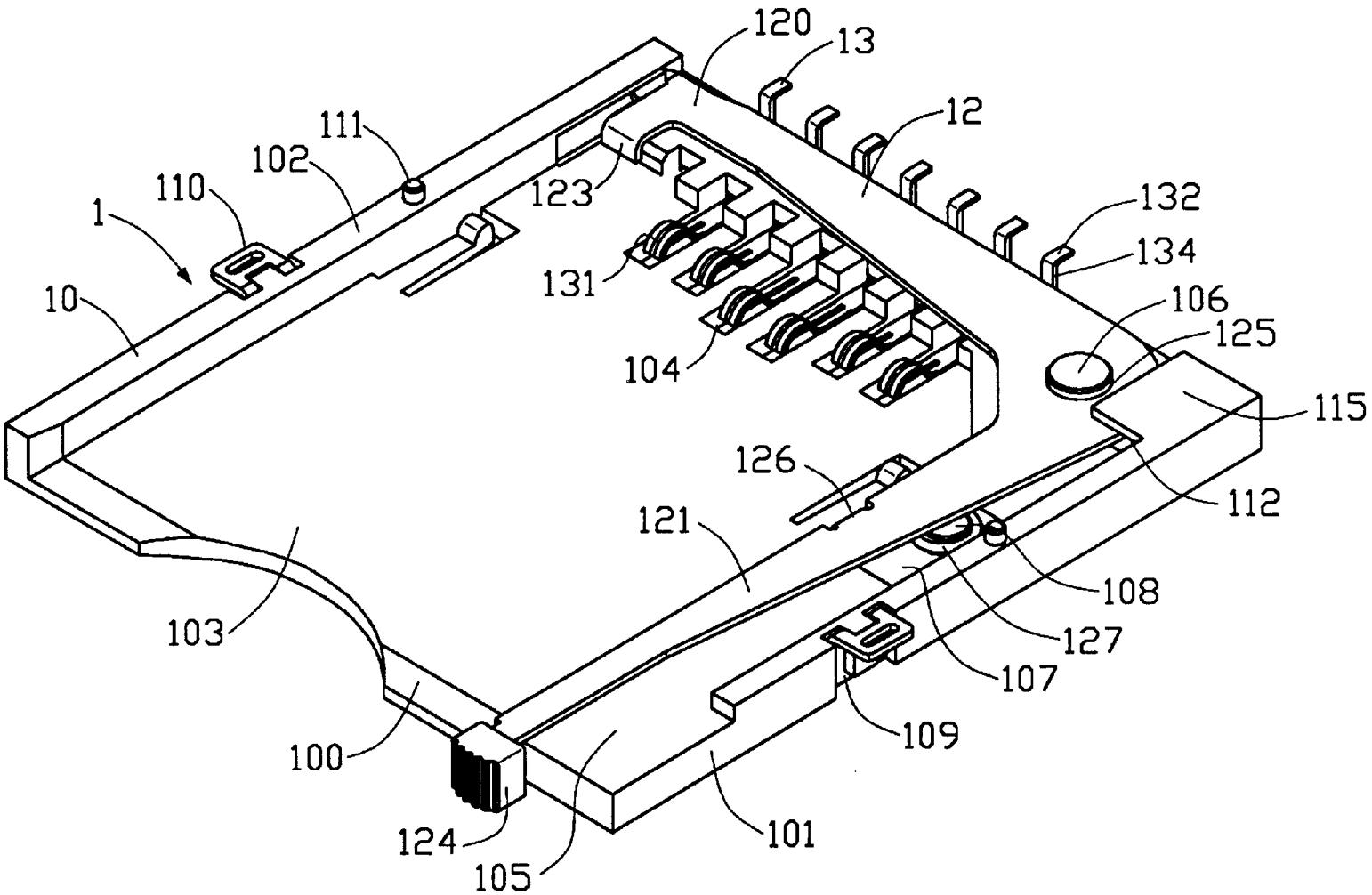
FIG. 2 is an assembled view of FIG. 1.

Referring to FIGS. 1 and 2, an electronic card connector according to the present invention includes an insulating housing 10, a plurality of conductive terminals 13 received in the housing 10, and an integrally formed ejector mechanism 12. The housing 10 includes a bottom wall 100, a first side wall 101 and a second side wall 102 opposite the first side wall 101. A card-receiving cavity 103 is defined between the first and second side walls 101 and 102 for receiving an electronic card 2. A guide bracket 105, which is preferably L-shaped, is unitarily formed on the bottom wall 100 for positioning the ejector mechanism 12. The guide bracket 105 has a first arm 151 transversely extending along a front end of the bottom wall 100, and a second arm 152 longitudinally extending on the bottom wall 100 and adjacent the first side wall 101. A holding block 154 extends rearwardly from an end of the first arm 151. A plurality of terminal receiving passageways 104 are defined in a front portion of the bottom wall 100 and longitudinally extend into a rear portion of the first arm 151 for receiving the conductive terminals 13. An end block 115 extends inwardly from a front portion of the first side wall 101. A slot 112 is defined below the end block 115 for receiving a part of the ejector mechanism 12. A locating portion 106 projects upwardly beside the slot 112. The locating portion 106 is preferably cylindrical in shape. A recess 107 is defined in a middle portion of the second arm 152, and a guide post 108 projects from a bottom of the recess 107. A pair of cutouts 109 is respectively defined in outer surfaces of the first and the second side walls 101 and 102 for holding a pair of solder pads 110 therein. Each solder pad 110 includes a planar body portion 114 for being held in the corresponding cutout 109 and a solder foot 113 perpendicular to the body portion 114. Each of the first and the second side walls 101 and 102 has a protuberance 111 formed adjacent an inner edge thereof for positioning the electronic card connector on a printed circuit board (not shown).

Each conductive terminal 13 includes a substantially planar retention portion 130, a contacting portion 131 extending from one end of the retention portion 130, a connecting portion 134 perpendicularly and upwardly projecting from an opposite end of the retention portion 130, and a soldering portion 132 perpendicularly extending from a free end of the connecting portion 134. Therefore the soldering portion 132 and solder feet 113 of the solder pads 110 can be oriented in the same plane for simplifying the soldering process. The contacting portion 131 is arcuate and projects beyond the bottom wall 100 of the housing 10 for electrically connecting with the electronic card 2.

The ejector mechanism 12 is unitarily formed, and includes a first bar 120 and a second bar 121 substantially perpendicular to the first bar 120. The ejector mechanism 12 is placed on the L-shaped guide bracket 105 and occupies no extra space of the housing 10, thus minimizing the profile of the electronic card connector. An actuation portion 124 is provided on a free end of the second bar 121. A first ejection tab 123 for abutting the electronic card 2 rearwardly and downwardly depends from a free end of the first bar 120, providing the first ejection tab 123 with the maximum stroke when ejecting the electronic card 2. A hole 125 is defined at a junction portion of the first bar 120 and the second bar 121 for mating with the locating portion 106. A second ejection tab 126 downwardly extends from approximately a middle portion of an inner edge of the second bar 121.

The electronic card connector further has a spring element 127 for returning the ejector mechanism 12 to its reset position. Preferably, the spring element 127 is a torsion spring having two free ends.

In assembly, the spring element 127 encircles the guide post 108, one free end thereof biasing against an inward surface of the first side wall 101, and the other free end thereof biasing against the second ejection tab 126. The ejector mechanism 12 is disposed on the guide bracket 105, the first bar 120 being located on the first arm 151 and the second bar 121 being located on the second arm 152. The slot 112 and the end block 115 receive and secure the juncture portion of the first and the second bars 120 and 121, thereby preventing the ejector mechanism 12 from disengaging from the locating portion 106. The first ejection tab 123, in its reset position, engages with a rearward surface of the holding block 154 to define a front limit position. The locating portion 106 is received in the hole 125 of the ejector mechanism for positioning the ejector mechanism 12. The actuation portion 124 extends beyond the housing for manual operation.

Figure 3:
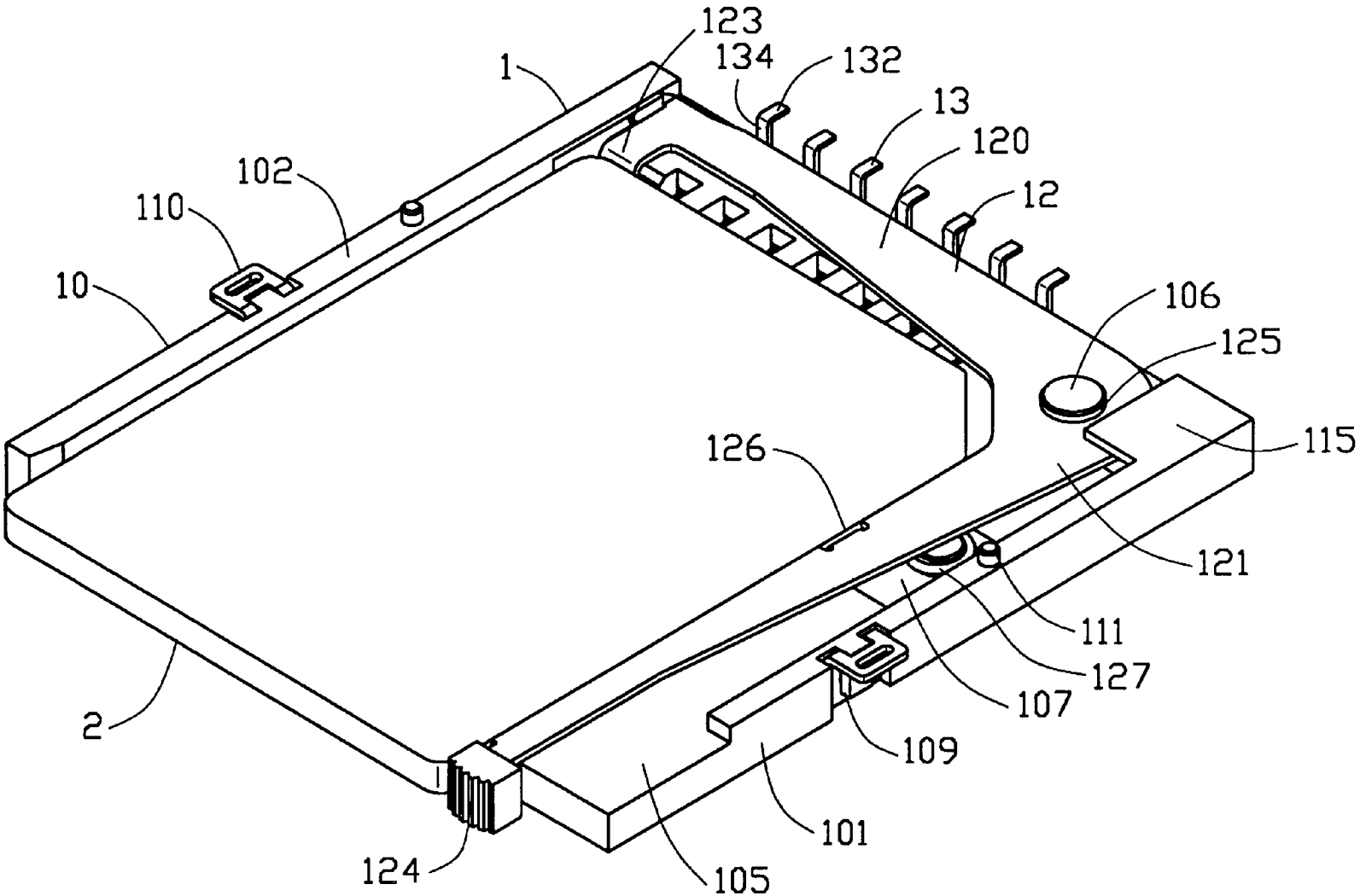
FIG. 3 is a perspective view of an electronic card being inserted into the electronic card connector.

Referring to FIGS. 2 and 3, when the electronic card 2 is inserted into the card-receiving cavity 103, the contacts (not shown) of the electronic card 2 contact the contacting portions 131 of the terminals 13. The first ejection tab 123 abuts a front edge of the electronic card 2.

Figure 4:
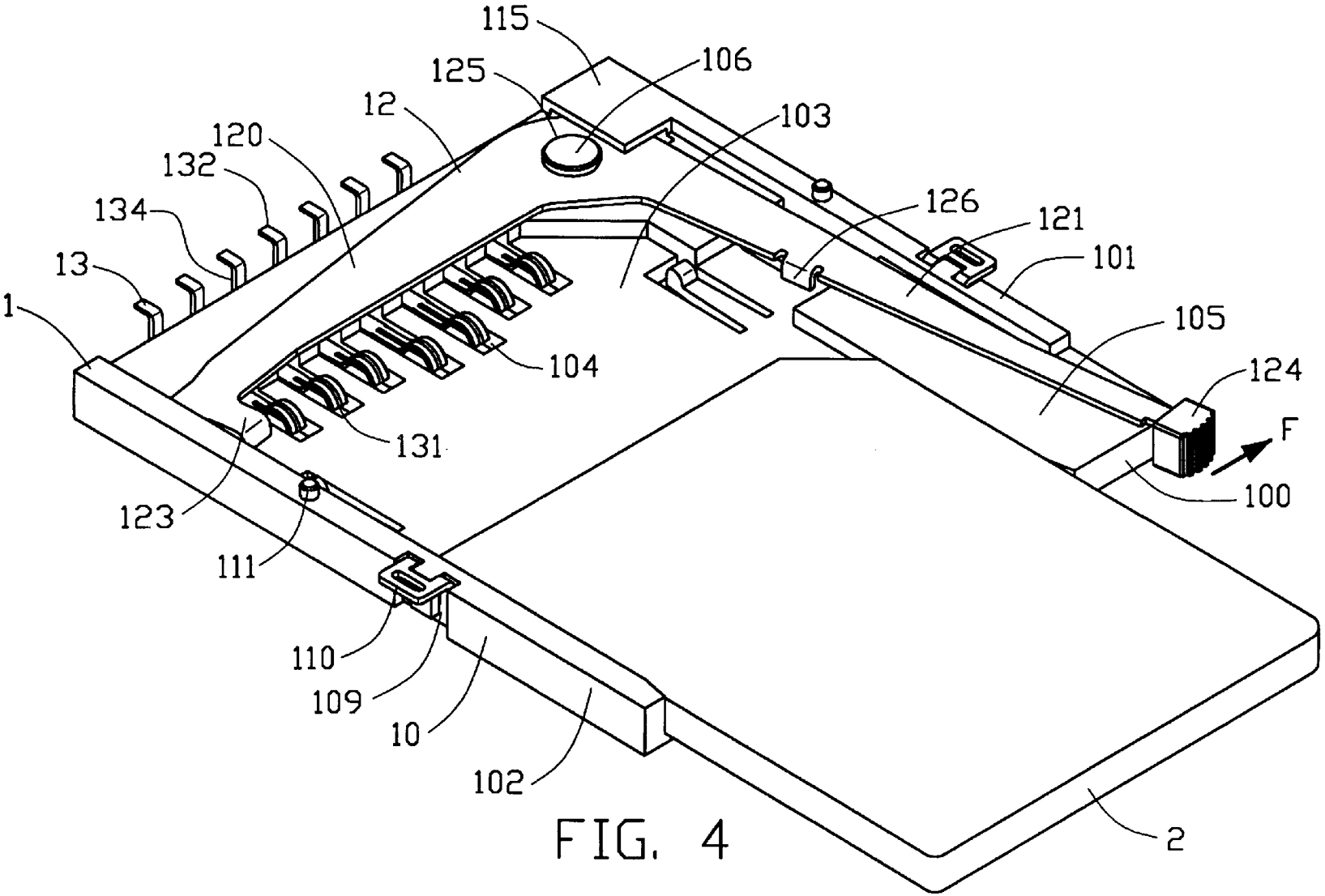
FIG. 4 is a perspective view of the electronic card being ejected from the electronic card connector.

Referring to FIG. 4, when a push force F is exerted on the actuation portion 124 of the second bar 121 in the direction shown by the arrow in the drawing, the actuation portion 124 moves laterally and outwardly. The first bar 120 rotates around the locating portion 106. The first ejection tab 123 moves rearwardly to eject the electronic card 2. The second ejection tab 126 moves laterally and compresses the spring element 127. When the push force F is released, the compressed spring element 127 pushes the second ejection tab 126 outwardly, urging the ejector mechanism 12 back to its reset position. This design provides an easy operation due to the automatic reset of the ejector mechanism 12.

It can be understood that different from the prior art connectors using either two-piece or three-piece ejection mechanism which result in linear plus rotative movements, the invention directly uses only one piece ejection mechanism resulting in only rotative movement thereof. Obviously, to achieve the better performance, in the rejection mechanism 12 the pivotal hole 125, the ejection tab 123 and the actuation portion 124 are preferably located around three corners of the housing 10.

It will be understood that the invention may be embodied in other special forms without departing from the spirit or central characteristic thereof. The present examples and embodiment therefore are to be considered in all respects as illustrative and not restrictive, and the invention is not to be limited to the details given herein.

What is claimed is:

1. An electrical connector for interconnecting an electronic card with a printed circuit board, comprising:

an insulating housing including a bottom wall, a first side wall, a second side wall opposite the first side wall, and a card-receiving cavity defined between the first and second side walls;

a plurality of conductive terminals received in the insulating housing; and a unitarily formed ejector mechanism mounted on the insulating housing, the ejector mechanism including a first bar and a second bar substantially perpendicular to the first bar, the first bar having a first ejection tab rearwardly and downwardly depending from a free end thereof for abutting a card received in the housing, the second bar having a free end accessible from an outside of the insulating housing to be laterally moved to cause the first ejection tab to move rearwardly to eject the card;

wherein said insulating housing has a guide bracket on the bottom wall, the guide bracket including a first arm and a second arm substantially perpendicular to each other and respectively for supporting the first and second bars of the ejector mechanism;

wherein a hole is defined in a junction of the first bar and the second bar, and wherein a locating portion is formed on a junction portion of the first and second arms of the guide bracket for being received in the hole;

wherein said guide bracket defines a slot in a front end thereof for receiving a part of the ejector mechanism;

further comprising a spring element mounted on said insulating housing and a second ejection tab downwardly extending from an inner edge of the second bar, the spring element having a pair of free ends, one free end biasing against the first side wall, and the other free end biasing against the second ejection tab;

wherein a recess is defined at approximately a middle portion of the second arm of the guide bracket, and a guide post projects from a bottom of the recess for receiving the spring element;

wherein an actuation portion is provided on the free end of the second bar for being manually operated.

* * * * *